US005547831A

United States Patent [19]

Fukui et al.

[11] Patent Number: 5,547,831

[45] Date of Patent: Aug. 20, 1996

[54] DRY PROCESS SILVER SALT PHOTOSENSITIVE MATERIAL AND IMAGE FORMING METHOD MAKING USE OF THIS DRY PROCESS SILVER SALT PHOTOSENSITIVE MATERIAL

[75] Inventors: Tetsuro Fukui, Yokohama; Motokazu Kobayashi, Kawasaki; Takehiko Ohi, Yokohama; Kazunori Ueno; Kenji Kagami, both of Atsugi; Masao Suzuki, Tokyo; Katsuya Nishino, Hiratsuka, all of Japan

[73] Assignee: Canon Kabushiki Kaisha, Tokyo, Japan

[21] Appl. No.: 152,209

[22] Filed: Nov. 16, 1993

[30] Foreign Application Priority Data

Nov. 18, 1992 [JP] Japan ..... 4-308782

[51] Int. Cl.[6] ..... G03C 1/498

[52] U.S. Cl. ..... 430/619; 430/203; 430/350; 430/577; 430/578; 430/580; 430/581; 430/591; 430/600; 430/613

[58] Field of Search ..... 430/619, 600, 430/613, 203, 581, 577, 580, 588, 591, 582, 578, 270, 328, 350, 614

[56] References Cited

U.S. PATENT DOCUMENTS

| | | | |
|---|---|---|---|
| 3,080,254 | 3/1963 | Grant, Jr. | 117/36.8 |
| 4,237,215 | 12/1980 | Ikemon et al. | 430/619 |
| 4,784,939 | 11/1988 | Van Pham . | |
| 5,021,321 | 6/1991 | Fukui et al. | 430/201 |
| 5,171,657 | 12/1992 | Kagami et al. | 430/271 |
| 5,258,281 | 11/1993 | Tanaka et al. | 430/619 |
| 5,258,282 | 11/1993 | Kagami et al. | 430/619 |

FOREIGN PATENT DOCUMENTS

| | | |
|---|---|---|
| 43-4921 | 2/1968 | Japan . |
| 43-4924 | 2/1968 | Japan . |
| 46-6074 | 12/1971 | Japan . |
| 47-1113 | 1/1972 | Japan . |
| 50-32927 | 3/1975 | Japan . |
| 53-9735 | 4/1978 | Japan . |
| 55-50246 | 4/1980 | Japan . |
| 55-42375 | 10/1980 | Japan . |
| 57-30828 | 2/1982 | Japan . |
| 57-138630 | 8/1982 | Japan . |
| 57-147627 | 9/1982 | Japan . |
| 58-107534 | 6/1983 | Japan . |
| 2-210352 | 8/1990 | Japan . |
| 3-135564 | 6/1991 | Japan . |
| 3-163454 | 7/1991 | Japan . |

*Primary Examiner*—Thorl Chea

*Attorney, Agent, or Firm*—Fitzpatrick, Cella, Harper & Scinto

[57] ABSTRACT

A dry process silver salt photosensitive material has a support and provided thereon a photosensitive layer containing at least an organic silver salt, a reducing agent and a photosensitive silver halide or a photosensitive silver halide forming component. The photosensitive layer is incorporated with a compound selected from the compounds (i), (ii) and (iii).

9 Claims, No Drawings

DRY PROCESS SILVER SALT PHOTOSENSITIVE MATERIAL AND IMAGE FORMING METHOD MAKING USE OF THIS DRY PROCESS SILVER SALT PHOTOSENSITIVE MATERIAL

BACKGROUND OF THE INVENTION

1. Field of the Invention

The present invention relates to a dry process silver salt photosensitive material, and also to an image forming method making use of this dry process silver salt photosensitive material.

2. Related Background Art

Hitherto known silver salt photography making use of a photosensitive silver halide is a recording technique that can achieve excellent photosensitivity and gradation, and has been most widely put into practical use. In this photography, however, the processing including developing, fixing and washing is carried out by a wet process, and hence it takes time and labor to carry out the processing. In addition, there are many problems on its operability and safety because of, e.g., anxiety about influence on human bodies by processing chemicals.

As a countermeasure therefor, much researches have been conducted on dry-process photography that does not require such wet processing, as disclosed in Japanese Patent Publications No. 43-4921, No. 43-4924, etc. These disclosures are concerned with a technique in which a photosensitive silver halide is used in an amount required as a catalyst and a non-photosensitive organic silver salt is used as an image forming agent. The mechanism by which the organic silver salt acts as an image forming agent can be explained as follows: (1) A silver nucleus is produced from a photosensitive silver halide as a result of imagewise exposure, and it forms a latent image. (2) The silver nucleus serves as a catalyst, an organic silver salt and a reducing agent cause oxidation-reduction reaction upon heating, and the organic silver salt is reduced to metallic silver, which forms a visible image.

As an example of methods of utilizing such a dry process silver salt photosensitive material, Japanese Patent Application Laid-open No. 55-50246 discloses a method of use as a mask. In this method, a silver image is used as a mask. As a photosensitive material capable of obtaining a polymer image with much better contrast than those utilizing the silver image mask, Japanese Patent Application Laid-open No. 3-135564 discloses, as a proposal made by the present applicant, a photosensitive material that utilizes light absorption of a light-absorbing organic compound that is an oxidized product of a reducing agent, to form an image with a better contrast.

The dry process silver salt photosensitive materials are advantageous over wet process silver salt photosensitive materials in view of the fact that no wet processing is required. Accordingly, it has been hitherto sought to make the former's photosensitivity and raw stock stability comparable to, or more improved than, the latter's. (The raw stock stability refers to the property that photosensitive materials can be stored while their photographic performance is maintained in the state exhibited immediately after their preparation.)

Since the dry process silver salt photosensitive materials are heated when development is carried out, it has also been sought to have a broad latitude in such materials for developing temperatures.

SUMMARY OF THE INVENTION

The present invention was made taking account of the circumstances stated above. An object thereof is to provide a dry process silver salt photosensitive material having a superior raw stock stability and also having a broad latitude for developing temperatures, and an image forming method making use of such a dry process silver salt photosensitive material.

The dry process silver salt photosensitive material of the present invention comprises a support and provided thereon a photosensitive layer containing at least an organic silver salt, a reducing agent and a photosensitive silver halide or a photosensitive silver halide forming component; said photosensitive layer being incorporated with a compound selected from the following compound (i), compound (ii) and compound (iii).

Compound (i):

$$[T^+X^-]Z_2$$

wherein $T^+$ represents an organic coloring matter cationic residual group, $X^-$ represents a counter anion, and Z represents a halogen atom.

Compound (ii):

A nitrogen-substituted halogen compound of an oxazinedione derivative.

Compound (iii):

A nitrogen-substituted halogen compound of an aromatic acid imide derivative.

The image forming method of the present invention comprises subjecting the above dry process silver salt photosensitive material to imagewise exposure and heating to form an image.

DESCRIPTION OF THE PREFERRED EMBODIMENTS

The dry process silver salt photosensitive material of the present invention comprises a support and provided thereon a photosensitive layer containing at least an organic silver salt, a reducing agent and a photosensitive silver halide or a photosensitive silver halide forming component. The photosensitive layer is incorporated with a compound selected from the following compounds (i), (ii) and (iii).

Compound (i):

$$[T^+X^-]Z_2$$

wherein $T^+$ represents an organic coloring matter cationic residual group, $X^-$ represents a counter anion, and Z represents a halogen atom.

Compound (ii):

A nitrogen-substituted halogen compound of an oxazinedione derivative.

Compound (iii):

A nitrogen-substituted halogen compound of an aromatic acid imide derivative.

The organic coloring matter cationic residual group $T^+$ of the compound (i) may include, for example, cyanine dye residual groups, styryl dye residual groups, aminovinyl dye residual groups, aniline dye residual groups, xanthene dye residual groups and phenoxazium dye residual groups. Typical structures of these are shown below as structural formulas (1) to (16). These by no means limit the present invention.

(1)
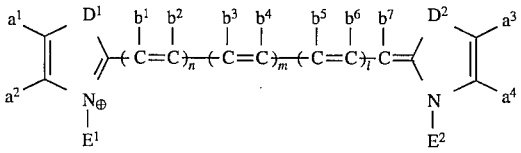
(2)
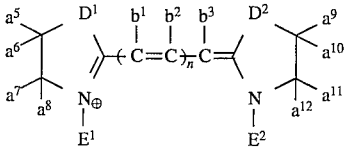
(3)
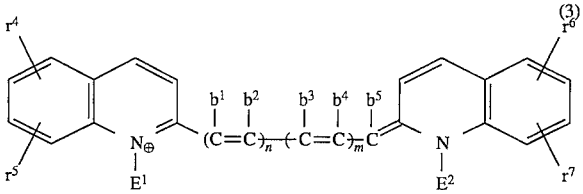
(4)
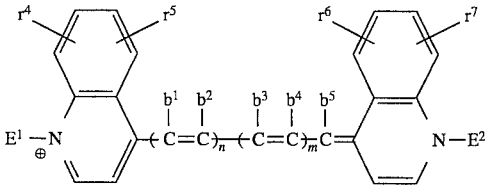
(5)
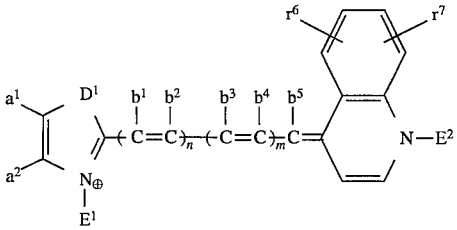
(6)
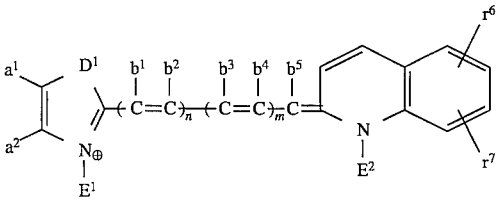
(7)
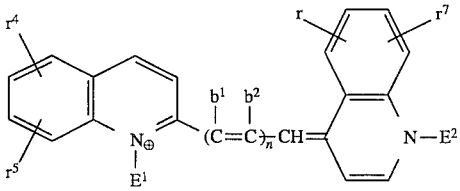
(8)
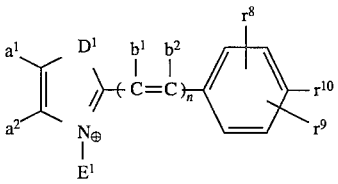
-continued
(9)
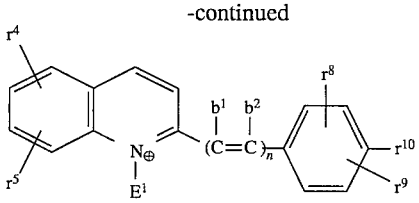
(10)
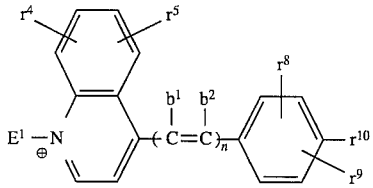
(11)
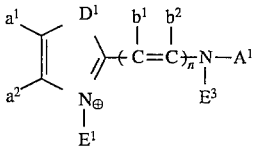
(12)
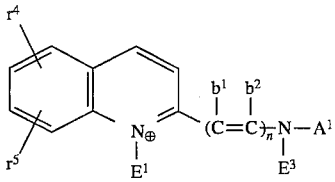
(13)
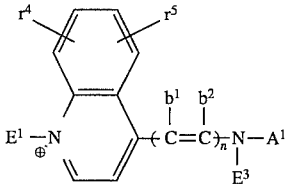
(14)
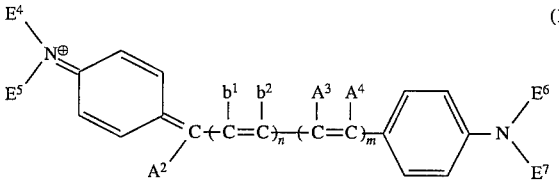
(15)
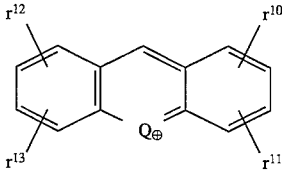
(16)
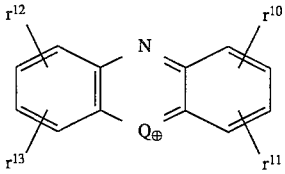
In the structural formulas (1) to (16), $a^1$, $a^2$, $a^3$ and $a^4$ may be the same or different and each represent a hydrogen atom, an aryl group, an alkyl group or an aralkyl group, where $a^1$ and $a^2$, and $a^3$ and $a^4$, may each combine to form a substituted or unsubstituted aromatic ring.

In the formulas, $b^1$, $b^2$, $b^3$, $b^4$, $b^5$, $b^6$ and $b^7$ may be the same or different and each represent a hydrogen atom, a halogen atom, an alkyl group, an aryl group, or a substituted or unsubstituted styryl group or heterocyclic group, which may arbitrarily combine each other to form a cyclic compound.

In the formulas, $a^5$, $a^6$, $a^7$, $a^8$, $a^9$, $a^{10}$, $a^{11}$ and $a^{12}$, may be the same or different and each represent a hydrogen atom or an alkyl group.

In the formulas, $D^1$ and $D^2$ each represent an oxygen atom, a sulfur atom, a selenium atom, $C(CH_3)_2$ Or N—$E_3$, where $E_3$ represents a hydrogen atom, an alkyl group, an alkoxyalkyl group, an acyl group or an aralkyl group.

In the formulas, $E^1$ and $E^2$ each represent an alkyl group, an alkoxyalkyl group, an aralkyl group, a carboxyalkyl group, a sulfoxyalkyl group or an alkenyl group.

The substituents $r^4$, $r^5$, $r^6$, $r^7$, $r^8$ and $r^9$ may be the same or different and each represent a hydrogen atom, a halogen atom, an alkyl group, an aralkyl group, an alkoxyl group, an aryl group or an alkoxyalkyl group, where $r^4$ and $r^5$, $r^6$ and $r^7$, and $r^8$ and $r^9$ may each combine to form a substituted or unsubstituted aromatic ring.

In the formulas, $E^4$, $E^5$, $E^6$ and $E^7$ each represent an alkyl group, a cycloalkyl group, an aralkyl group, an alkoxyalkyl group, an alkenyl group or an alkynyl group, where $E^4$ and $E^5$ and $E^6$ and $E^7$, may each combine to form a cyclic compound.

In the formulas, $A^1$ and $A^2$ each represent an alkyl group or an aryl group.

In the formulas, $A^3$ and $A^4$ each represent a hydrogen atom, a halogen atom, an alkyl group or an aryl group, and may combine with any of the above $b^1$ and $b^2$ to form a cyclic compound.

In the formulas, $r^{10}$, $r^{11}$, $r^{12}$ and $r^{13}$ each represent a hydrogen atom, an alkyl group, a nitro group or an amino group.

In the formulas, Q represents an oxygen atom, a sulfur atom or N—$E_3$, where $E_3$ is as defined above.

In the formulas, m, n and l each represent 0, 1, 2 or 3.

The counter anion $X^-$ of the compound (i) may include anions such as a chloride ion, a bromide ion, an iodide ion, a perchloride ion, a benzensulfonate ion, a p-toluenesulfonate ion, a methylsulfate ion, an ethylsulfate ion, a propylsulfate ion, a tetrafluoroborate ion, a tetraphenyl borate ion, a hexafluorophosphate ion, a benzene sulfinate ion, an acetate ion, a trifluoacetate ion, a propionyl acetate ion, a benzoate ion, an oxalate ion, a succinate ion, a malonate ion, an oleate ion, a stearate ion, a citrate ion, a monohydrogen diphosphate ion, a dihydrogen monophosphate ion, a pentachlorostannate ion, a chlorosulfonate ion, a fluorosulfonate ion, a trifluoromethane sulfonate ion, a hexafluoroantimonate ion, a molybdate ion, a tungstate ion, a titanate ion, and a zirconate ion. Of these, halide anions, in particular, a bromide ion and an iodide ion are preferred.

The halogen atom Z may preferably be exemplified by Br, I or Cl.

Preferred examples of the compound (i) shown below.

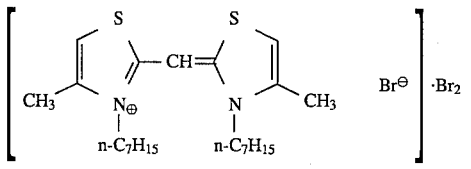
(i-1)

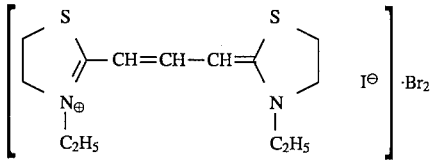
(i-2)

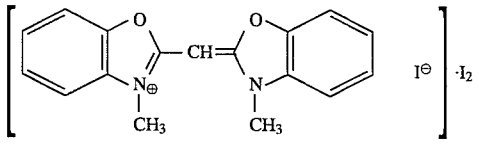
(i-3)

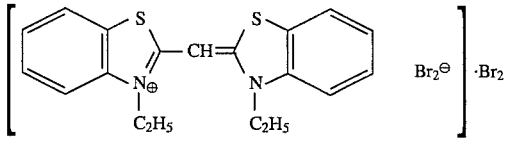
(i-4)

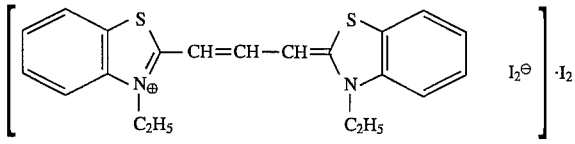
(i-5)

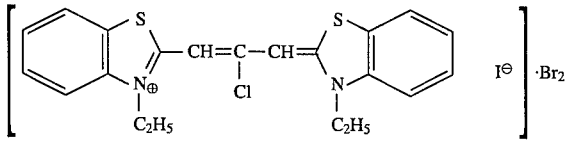
(i-6)

-continued
(i-7)
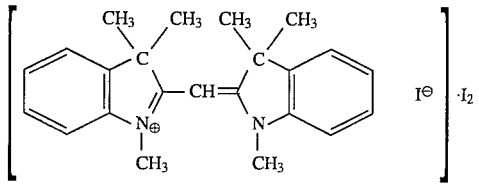
(i-8)
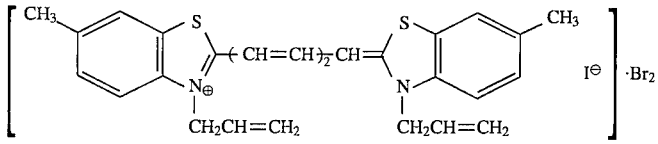
(i-9)
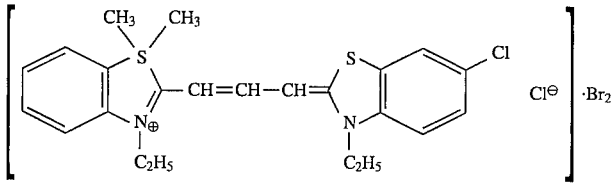
(i-10)
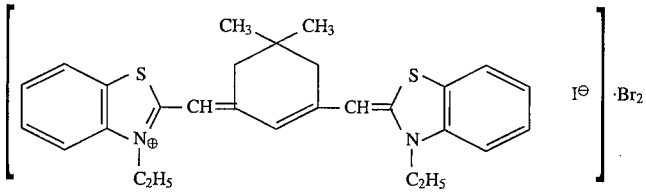
(i-11)
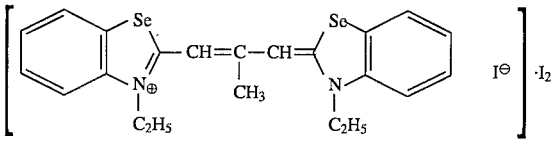
(i-12)
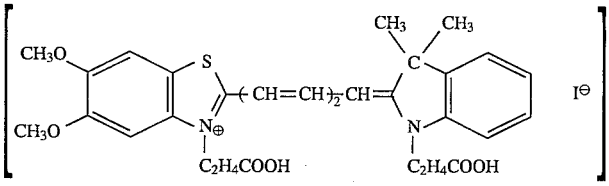
(i-13)
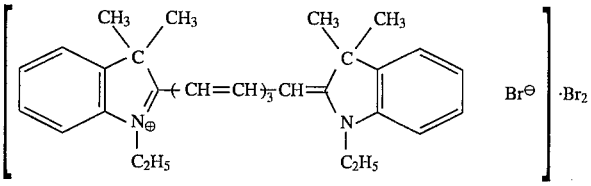
(i-14)
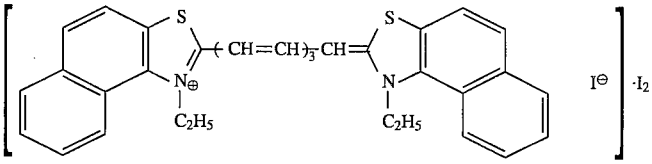
(i-15)
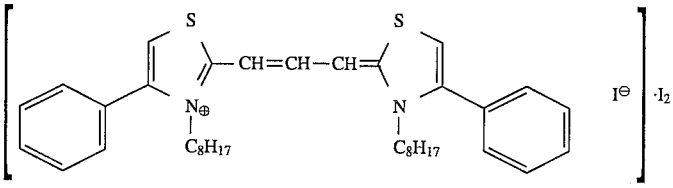

-continued
(i-16)
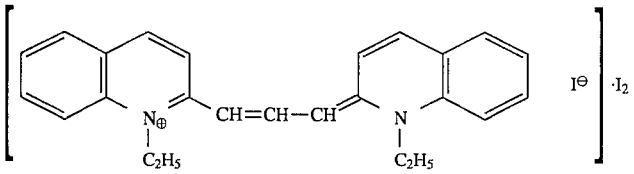
(i-17)
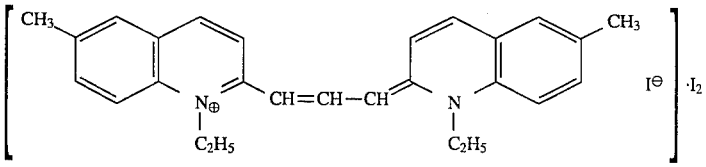
(i-18)
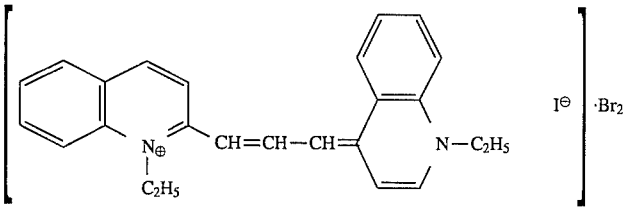
(i-19)
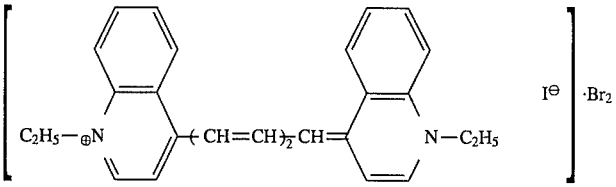
(i-20)
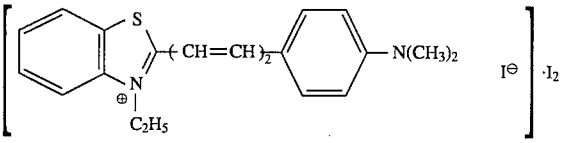
(i-21)
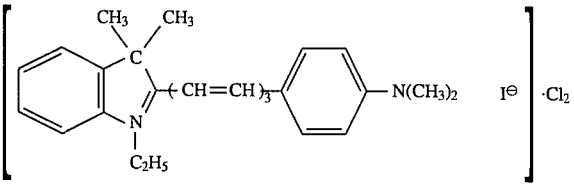
(i-22)
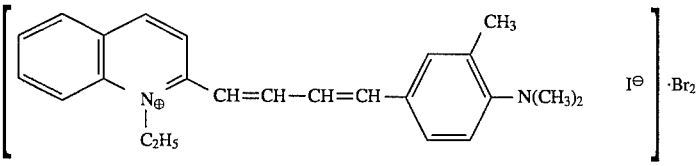
(i-23)
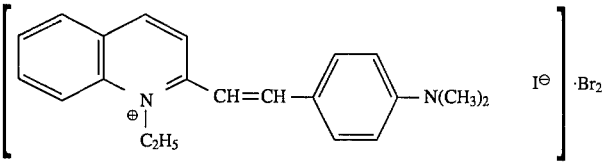
(i-24)
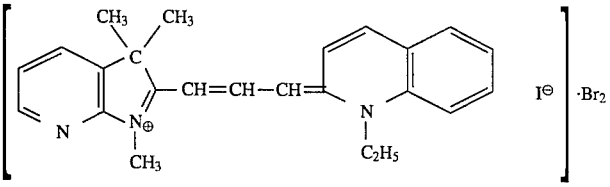

-continued
(i-25)
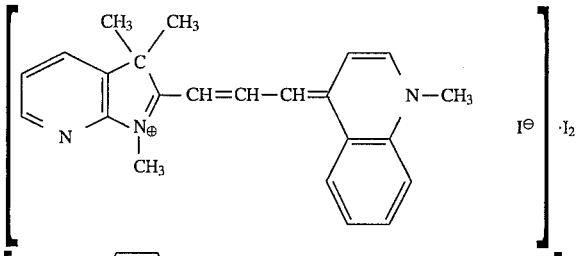
(i-26)
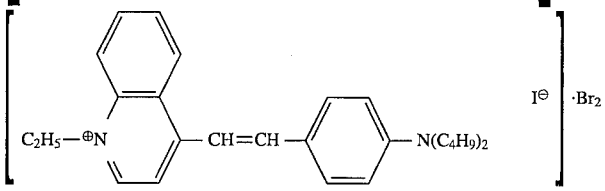
(i-27)
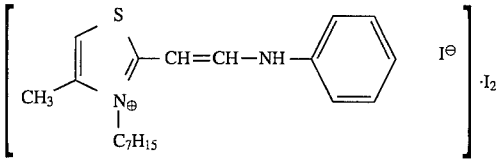
(i-28)
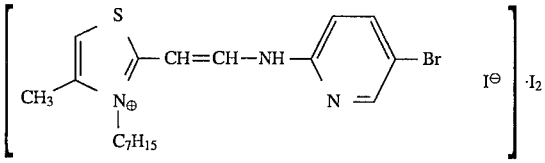
(i-29)
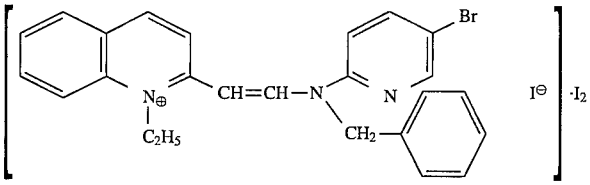
(i-30)
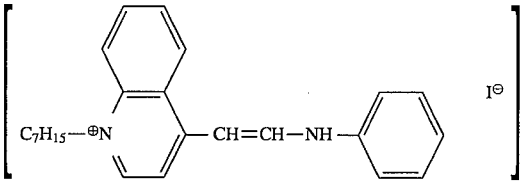
(i-31)
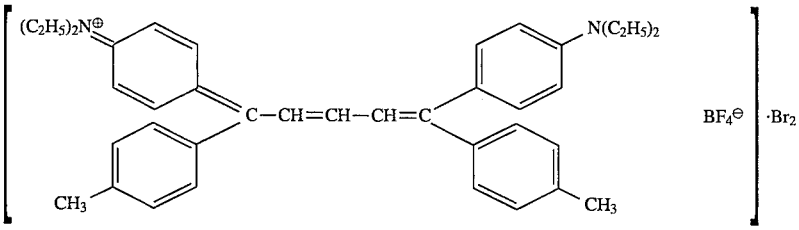
(i-32)
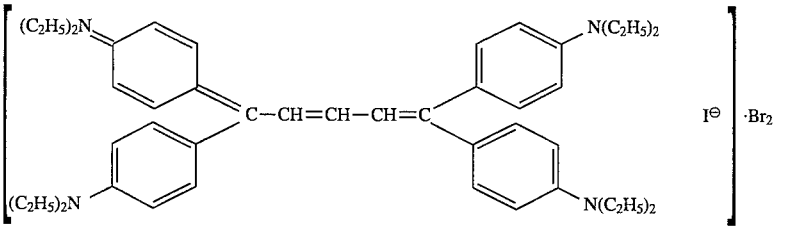

-continued

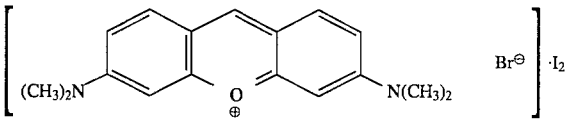

(i-33)

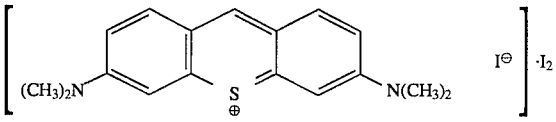

(i-34)

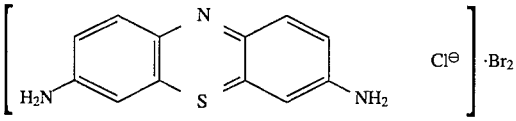

(i-35)

The compound (ii) may preferably be exemplified by a compound of the following Formula (I).

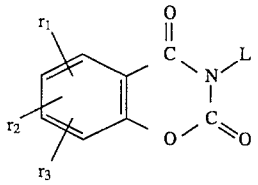

Formula (I)

In Formula (I), $r_1$, $r_2$ and $r_3$ may be the same or different and each represent a hydrogen atom, an alkyl group, an alkoxyl group, a halogen atom, a hydroxyl group, an aryl group, an aralkyl group, an alkoxyalkoxyl group or an amino group, where any two of $r_1$, $r_2$ and $r_3$ may combine to form a condensed ring. L represents a halogen atom. The halogen atom L may preferably be exemplified by Br, I or Cl.

Preferred examples of the compound (ii) are shown below.

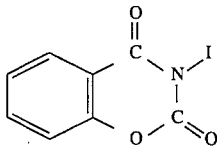

(ii-1)

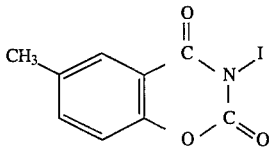

(ii-2)

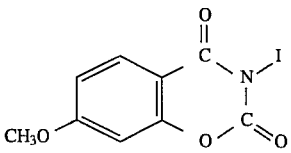

(ii-3)

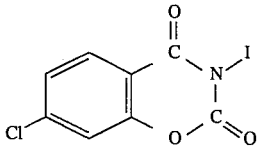

(ii-4)

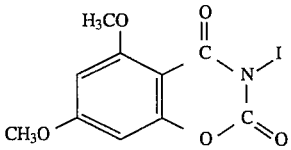

(ii-5)

-continued

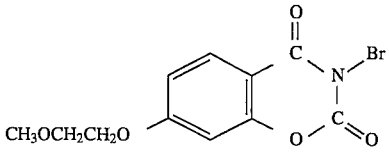

(ii-6)

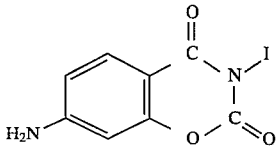

(ii-7)

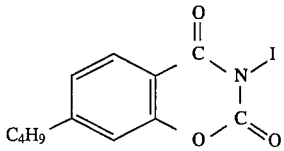

(ii-8)

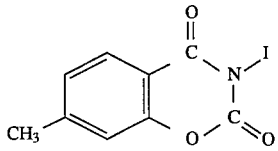

(ii-9)

The compound (iii) may preferably be compound of the following Formula (II).

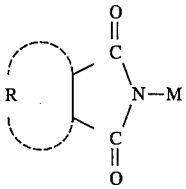

Formula (II)

In Formula (II), R represents an organic residual group that forms a substituted or unsubstituted aromatic ring. M represents a halogen atom. The halogen atom M may preferably be exemplified by Br, I or Cl.

Of the compounds of Formula (II), a nitrogen-substituted halogen compound of a phthalimide derivative or a nitrogen-substituted halogen compound of a naphthalimide derivative is preferred.

Preferred examples of the compound (iii) are shown below.

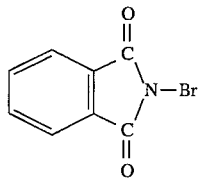
(iii-1)

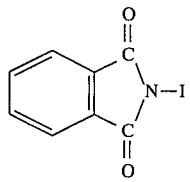
(iii-2)

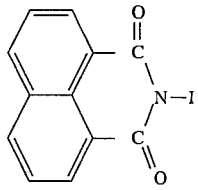
(iii-3)

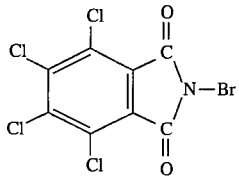
(iii-4)

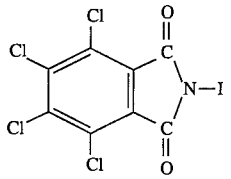
(iii-5)

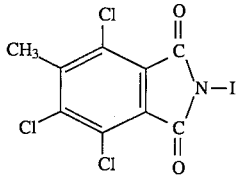
(iii-6)

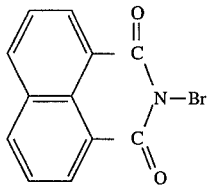
(iii-7)

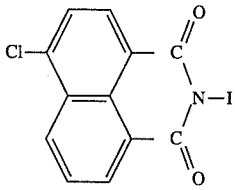
(iii-8)

The organic silver salt may preferably include those having 12 to 24 carbon atoms. Organic salts having 12 to 24 carbon atoms do not tend to undergo any unauthorized changes such as coloring under indoor light. Preferred organic silver salts can be exemplified by silver benzotriazole, silver behenate, silver stearate, silver palmitate, silver myristate, silver laurate, silver oleate and silver hydroxystearate. Of these, silver behenate is particularly effective.

The reducing agent is an agent capable of reducing the organic silver salt to form metallic silver when the dry process silver salt photosensitive material has been subjected to imagewise exposure and heat development. The reducing agent may include hydroquinone, methylhydroquinone, chlorohydroquinone, methylhydroxynaphthalene, N,N'-diethyl-p-phenylenediamine, aminophenol, ascorbic acid and 1-phenyl- 3-pyrazolidone. Besides these, 2,2'-methylenebis(6-tert-butyl-4-methylphenol), 4,4'-butylidenebis(6-tert-butyl-3-methylphenol) and 4,4'-thiobis(6-tert-butyl-3-methylphenol), as well as bisnaphthol type reducing compounds disclosed in Japanese Patent Application Laid-open No. 46-6074, 4-benzenesulfonamidophenol compounds disclosed in Japanese Patent Publication No. 53-9735 and compounds disclosed in Japanese Patent Applications Laid-open No. 2-210352 and No. 3-135564 are preferable.

The photosensitive silver halide may include, for example, silver chloride, silver bromide, silver iodide, silver iodobromide, silver iodochloride and silver iodochlorobromide. The photosensitive silver halide is particularly effective when it is in the form of fine grains. Fine-grain silver halides can be prepared by any methods including a method in which the organic silver salt is converted into a halide by the use of a silver halide forming component as exemplified by ammonium bromide, lithium bromide, sodium chloride or N-bromosuccinimide.

The photosensitive layer may optionally contain a binder. The binder may preferably be a hydrophobic or hydrophilic polymer, and may be transparent or semitransparent. It may specifically include polyvinyl butyral, cellulose acetate butyrate, polymethyl methacrylate, polyvinyl pyrrolidone, ethyl cellulose, cellulose acetate, polyvinyl acetate, polyvinyl alcohol and gelatin.

The photosensitive layer may be comprised of a single layer, or may be of multi-layer structure wherein a first photosensitive layer containing the organic silver salt, the reducing agent and the photosensitive silver halide or photosensitive silver halide forming component and a second photosensitive layer containing one selected from the compounds (i), (ii) and (iii) are formed layer by layer.

When the photosensitive layer is made to have the multi-layer structure, the first photosensitive layer and the second photosensitive layer may be superposed or laminated in this order from the support side, or may be in reverse order. Preferably, they may be superposed in the order of the first photosensitive layer and the second photosensitive layer from the side on which light is shed in the step of imagewise exposure.

The compound (i) may preferably be in a content, when the photosensitive layer is comprised of a single layer, of from $1\times10^{-4}$ mol to $5\times10^{-1}$ mol, more preferably from $5\times10^{-4}$ mol to $1\times10^{-1}$ mol, and particularly preferably from $1\times10^{-4}$ mol to $1\times10^{-2}$ mol, per mol of the organic silver salt. The compound (ii) or (iii) may preferably be in a content, when the photosensitive layer is comprised of a single layer, of from $1\times10^{-4}$ mol to 5×10–1 mol, more preferably from $5\times10^{-4}$ mol to $5\times10^{-1}$ mol, and particularly preferably from $1\times10^{-3}$ mol to $1\times10^{-1}$ mol, per mol of the organic silver salt.

When the photosensitive layer is comprised of multi-layer structure, any of the compounds (i), (ii) and (iii) may preferably be in the same content of from $5\times10^{-4}$ mol to 10 mols, more preferably from $5\times10^{-3}$ mol to 0.5 mol, and particularly preferably from $5\times10^{-2}$ mol to 0.5 mol, per mol of the organic silver salt.

The organic silver salt, the reducing agent and the photosensitive silver halide may be in the following content without regard to the layer structure of the photosensitive layer.

The organic silver salt may preferably be in a content of from 0.3 g/m$^2$ to 30 g/m$^2$, particularly from 0 7 g/m$^2$ to 15 g m$^2$, and more preferably from 1.2 g/m$^2$ to 8 g/m$^2$.

The photosensitive silver halide may preferably be in a content of from 0.001 mol to 0.50 mol, and more preferably from 0.01 mol to 0.30 mol, per mol of the organic silver salt. The photosensitive silver halide forming component may also be in the same content as that of the photosensitive silver halide.

The reducing agent may preferably be in a content of from 0.05 mol to 3 mols, and more preferably from 0.2 mol to 1.3 mols, per mol of the organic silver salt.

When the photosensitive layer is comprised of a single layer, the binder that is optionally contained therein may preferably be in an amount of from 0.1 part by weight to 10 parts by weight, and more preferably from 0.5 part by weight to 4 parts by weight, based on 1 part by weight of the organic silver salt.

When the photosensitive layer is comprised of multi-layer structure, the binder that is optionally contained in the first photosensitive layer may be in the same amount as in the case when the photosensitive layer is comprised of a single layer. In the second photosensitive layer, the binder may preferably be contained in an amount of from 0.1 part by weight to 100 parts by weight, and more preferably from 0.5 part by weight to 50 parts by weight, based on 1 part by weight of the compound (i), (ii) or (iii). Binders that may be contained in the first photosensitive layer and the second photosensitive layer may be the same as the binder described above.

The photosensitive layer may preferably have a thickness of from 0.1 μm to 50 μm, more preferably from 1 μm to 30 μm, and particularly preferably from 2 μm to 20 μm. In the case when the photosensitive layer is made to have the multi-layer structure, the thickness of the whole photosensitive layer should be within the above range. In the photosensitive layer of multi-layer structure, the second photosensitive layer containing the compound (i), (ii) or (iii) may preferably have a thickness of from 0.01 μm to 30 μm, and more preferably from 0.1 μm to 10 μm.

The photosensitive layer of the present invention is formed by applying to the support a coating solution in which the constituents have been dissolved, followed by drying. The compound (i), (ii) or (iii) may be added when the organic silver salt and the silver halide are synthesized, or may be added when the organic silver salt, the reducing agent and the photosensitive silver halide are dispersed.

The photosensitive layer may also be formed in the following way: A coating solution in which the organic silver salt, the reducing agent and the photosensitive silver halide have been dissolved is coated on the support, followed by drying to form a coating, and thereafter the support on which this coating has been formed is dipped in a solution in which the compound (i), (ii) or (iii) has been dissolved.

The support may include polyethylene film, polypropylene film, polyethylene terephthalate film, polycarbonate film, cellulose acetate film, synthetic paper, paper covered with a synthetic film such as polyethylene film, art paper, photographic baryta paper, aluminum sheet, glass sheet, and synthetic films having a metal-deposited film.

In the present invention, in order to improve color tone of images and stability after image formation, the photosensitive layer or the first photosensitive layer may be incorporated with an organic acid, a tone modifier, an antifoggant, an anti-coloring agent, a development accelerator, an antistatic agent, a sensitizing dye, an ultraviolet absorbent, an anti-irradiation dye, a fluorescent brightener, a filter dye, and so forth.

The organic acid may preferably include, in particular, the same fatty acids as those constituting the organic silver salt or those similar thereto, which may preferably be used alone or in combination. Such fatty acid(s) may be used in an amount of from 25 mol % to 200 mol %, and particularly preferably from 30 mol % to 120 mol %, based on the organic silver salt.

The tone modifier may include phthalazinone or derivatives thereof as disclosed in U.S. Pat. No. 3,080,254, dry process imides as disclosed in Japanese Patent Application Laid-open No. 46-6074 and phthalazinedione compounds as disclosed in Japanese Patent Application Laid-open No. 50-32927, any of which may be used.

The antifoggant may include mercury compounds as disclosed in Japanese Patent Publication No. 47-11113, 1,2,4-triazole compounds as disclosed in Japanese Patent Publication No. 55-42375, tetrazola compounds as disclosed in Japanese Patent Application Laid-open No. 57-30828, benzoic acids as disclosed in Japanese Patent Application Laid-open No. 57-138630, compounds having a sulfonylthio group as disclosed in Japanese Patent Application Laid-open No. 57-147627 and dibasic acids as disclosed in Japanese Patent Application Laid-open No. 58-107534. In particular, the dibasic acids as disclosed in Japanese Patent Application Laid-open No. 58-107534 are preferred as the antifoggant used in the present invention.

The antistatic agent may preferably be exemplified by a fluorine-containing surface active agent.

The sensitizing dye may include, for example, cyanine dyes and merocyanine dyes.

The dry process silver salt photosensitive material is subjected to imagewise exposure and heating (heat development), where the organic silver salt and the reducing agent react at the imagewise exposed area to cause oxidation-reduction reaction, and the metallic silver produced as a result of the reaction forms a blackened image.

The dry process silver salt photosensitive material of the present invention can also form a pattern comprised of a polymerized area and an unpolymerized area (hereinafter "polymerized-unpolymerized pattern"), utilizing light-absorbing properties of an oxidized product formed by the oxidation-reduction reaction (a product by oxidation of the reducing agent). More specifically, the photosensitive layer (or, in the case when the photosensitive layer is comprised of multi-layer structure, the first photosensitive layer) according to the present invention may be incorporated with a polymerizable polymer precursor and a photopolymerization initiator, and is subjected to imagewise exposure, heating (heat development) and polymerization exposure, so that the polymerized-unpolymerized pattern can be formed. The mechanism by which the polymerized-unpolymerized pattern is formed in this way is that in the area where the oxidized product has been formed no polymerization proceeds because of the light absorption attributable to the oxidized product, and in the area where the oxidized product has not been formed the polymerization proceeds.

The polymerized-unpolymerized pattern can be formed also when the oxidized product has a chemical polymerization inhibitory action, like the case when the oxidized product has light-absorbing properties. In the case when the oxidized product has a chemical polymerization inhibitory action, a heat polymerization initiator may be used as a polymerization initiator in addition to the photopolymerization initiator. In the case when the heat polymerization initiator is used as the polymerization initiator, the polymerized-unpolymerized pattern is formed as the polymerization at the imagewise-unexposed area proceeds as a result of imagewise exposure and heating (heat development).

The dry process silver salt photosensitive material can also form the polymerized-unpolymerized pattern, utilizing radicals produced by the oxidation-reduction reaction. More specifically, the photosensitive layer (or, in the case when the photosensitive layer is comprised of multi-layer structure, the first photosensitive layer) according to the present invention may be incorporated with a polymerizable polymer precursor, and the polymerization at the imagewise-exposed area proceeds by the action of the radicals produced by the oxidation-reduction reaction, so that the polymerized-unpolymerized pattern can be formed.

Whether the oxidized product with light-absorbing properties is produced, the oxidized product with a chemical polymerization inhibitory action is produced or the radicals are generated as a result of oxidation-reduction reaction depends on the type of the reducing agent used.

The polymerizable polymer precursor and the polymerization initiator may be contained in the photosensitive layer. Alternatively, a polymerizing layer containing the polymerizable polymer precursor and polymerization initiator may be provided separately from the photosensitive layer. The photosensitive layer and the polymerizing layer may be superposed in the order of the polymerizing layer and the photosensitive layer from the support side or in the order of the photosensitive layer and the polymerizing layer from the support side. Alternatively, they may hold a support between them, one side of which the photosensitive layer is provided and the other side of which the polymerizing layer is provided.

As the polymerizable polymer precursor, a compound having at least one reactive vinyl group in its molecule can be utilized. For example, at least one selected from the group consisting of reactive vinyl group-containing monomers, reactive vinyl group-containing oligomers and reactive vinyl group-containing polymers can be used.

The reactive vinyl group in these compounds may include substituted or unsubstituted vinyl groups having polymerization reactivity, as exemplified by styrene vinyl groups, acrylic acid vinyl groups, methacrylic acid vinyl groups, allyl vinyl groups, and vinyl ethers, as well as ester vinyl groups such as vinyl acetate.

Specific examples of the polymerizable polymer precursor satisfying such conditions are exemplified by styrene, methoxystyrene, dimethylaminostyrene, hydroxystyrene, aminostyrene, carboxystyrene, acrylic acid, methyl acrylate, ethyl acrylate, cyclohexyl acrylate, acrylamide, mathacrylic acid, methyl methacrylate, ethyl methacrylate, pentaerythritol triacrylate, pentaerythritol trimethacrylate, cyanuric acid triacrylate, cyanuric acid trimethacrylate, 1,1,1-trimethylolpropane triacrylate, 1,1,1-trimethylolpropane trimethacrylate, cyanuric acid tri(ethyl acrylate), 1,1,1-trimethylolpropane tri(ethyl acrylate), cyanuric acid tri(ethyl vinyl ether), a condensate of a reaction product of 1,1,1-trimethylolpropane and 3-fold mol of toluenediisocyanate, with hydroxyethyl acrylate, ethylenetetraacrylamide, and propylenetetraacrylamide. Any of these polymerizable polymer precursors may be used alone or in combination of several kinds.

The photopolymerization initiator includes, for example, carbonyl compounds, sulfur compounds, halogen compounds, and photopolymerization initiators of a redox type.

The carbonyl compounds may include diketones as exemplified by benzyl, 4,4'-dimethoxybenzyl, diacetyl, and camphorquinone; benzophenones as exemplified by 4,4'-diethylaminobenzophenone, and 4,4'-dimethoxybenzophenone; acetophenones as exemplified by acetophenone, and 4-methoxyacetophenone; benzoylalkyl ethers; thioxanthones as exemplified by 2-chlorothioxanthone, 2,5-diethylthioxanthone, and thioxanthone-3-carboxylic acid-β-methoxy ethyl ester; chalcones and styrylketones having a dialkylamino group; and coumarins as exemplified by 3,3'-carbonylbis(7-methoxycoumarin), and 3,3'-carbonylbis(7-diethylaminocoumarin).

The sulfur compounds include disulfides such as dibenzothiazolyl sulfide and decylphenyl sulfide.

The halogen compounds include, for example, carbon tetrabromide, quinolinesulfonyl chloride, and S-triazines having a trihalomethyl group.

In the photopolymerization initiator described above, two or more photopolymerization initiators can also be used in combination to effect a more efficient photopolymerization reaction. Such combination of the photopolymerization initiators includes a combination of chalcones having a dialkylamino group with styryl styrylketones and a combination of coumarins with S-triazines having a trihalomethyl group or camphorquinone. These polymerization initiators may also be used in combination of two or more kinds, or may be used in combination with the compound described above.

The heat polymerization initiator may include azo compounds such as azobisisobutyronitrile, and peroxides such as benzoyl peroxide.

The dry process silver salt photosensitive material of the present invention may also be incorporated with a heat-diffusible dye together with the polymerizable polymer precursor, and, after the polymerized-unpolymerized pattern has been formed, the dry process silver salt photosensitive material of the present invention and a recording paper may be put together and heated to cause the heat-diffusible dye to diffuse from the unpolymerized area, so that an image can be formed on the recording paper.

As the heat-diffusible dye, for example, the compounds as disclosed in Japanese Patent Application Laid-open No. 3-163454 can be used.

After the polymerized-unpolymerized pattern has been formed, the polymerized area and the unpolymerized area may be separated by peeling-apart, or the unpolymerized area may be removed by etching.

In the instance where the polymerizable polymer precursor and the polymerization initiator are used in the dry process silver salt photosensitive material of the present invention, the polymerization initiator may preferably be contained in an amount of from 0.01 mol to 10 mols, and more preferably from 0.5 mol to 3.0 mols, per mole of the reducing agent. The polymerization initiator should preferably be in an amount of from 0.1 part by weight to 30 parts by weight, and more preferably from 0.5 part by weight to 10 parts by weight, based on 100 parts by weight of the polymerizable polymer precursor.

In the case when the polymerizing layer is provided separately from the photosensitive layer, the polymerizing layer may preferably have a thickness of from 0.1 μm to 50 μm, more preferably from 1 μm to 30 μm, and particularly preferably from 2 μm to 20 μm.

As light sources used in the step of imagewise exposure, for example, LEDs, gas lasers, semiconductor lasers, xenon lamps, tungsten lamps and sunlight are preferable. The light for imagewise exposure may preferably comprise light having a wavelength of from 400 nm to 900 nm.

As a heating means used in the step of heat development, it is possible to use, for example, a hot plate, a heat roll or a thermal head. In the step of heat development, it is preferable to carry out the heating at a temperature of from 80° C. to 160° C. for a heating time of from 1 second to 3 minutes, and more preferably at a temperature of from 90° C. to 140° C. for a heating time of from 3 seconds to 90 seconds.

In the case when the polymerized-unpolymerized pattern is formed in the dry process silver salt photosensitive material of the present invention by polymerization exposure, light sources used for the polymerization exposure are preferably exemplified by halogen lamps, xenon lamps, tungsten lamps, mercury lamps, fluorescent lamps, and lasers, and the light for polymerization exposure may preferably comprise light having a wavelength of from 300 nm to 600 nm.

The wavelength of the light used in the step of imagewise exposure and the step of polymerization exposure may be the same or different. Even if the light having the same wavelength is used, the latent image can be sufficiently written with use of light having an intensity of the level that does not cause photopolymerization in the step of imagewise exposure, since the photosensitive silver halide usually has a sufficiently higher photosensitivity than the photopolymerization initiator. For example, in the step of imagewise exposure, the exposure may be carried out using light that may give about 1 mJ/cm$^2$ or less at the surface of the photosensitive material. In the step of polymerization exposure, the exposure may be carried out using light that may give about 500 mJ/cm$^2$ or less at the surface of the photosensitive material.

EXAMPLES

The present invention will be described below in greater detail by giving Examples. In the following, "part(s)" indicates "part(s) by weight".

Examples 1 to 5 & Comparative Example 1

Measurement (A)

Dispersion (a) with the following composition was prepared using a homomixer under safe light.

| | |
|---|---|
| Polyvinyl butyral | 4.0 parts |
| Silver behenate | 2.5 parts |
| Behenic acid | 1.5 parts |
| Homophthalic acid | 0.6 part |
| Silver bromide | 0.6 part |
| Phthalazinone | 0.5 part |
| 2,2'-Methylenebis(4-methyl-6-tert-butylphenol) | 2.4 parts |
| Xylene | 30 parts |
| n-Butanol | 30 parts |

The above silver bromide was comprised of cubic crystals having a plane index of {100}, one side of a crystal of which had a length of 0.07 μm.

To the dispersion (a), a solution prepared by dissolving in 5.0 parts of dimethylformamide (DMF) 0.03 part of a dye of the formula:

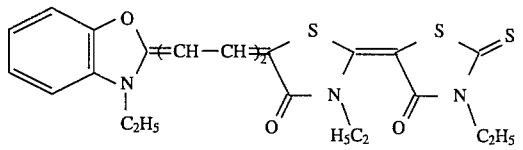

was added to obtain dispersion (b).

To 15.2 parts of the dispersion (b) thus obtained, 0.008 part of compound (i-3) previously set forth was added to produce dispersion (c), and this dispersion (c) was coated on a polyethylene terephthalate film (PET film) so as to be in a dried coating thickness of 10 μm, to form a photosensitive layer. On this photosensitive layer, a protective layer comprised of polyvinyl alcohol was formed in a thickness of 2 μm. Thus, a dry process silver salt photosensitive material of the present invention was produced (Example 1).

Example 1 was repeated to produce dry process silver salt photosensitive materials of Examples 2 to 5, except that 0.008 part of compound (i-3) was replaced with compounds (i-19), (i-34), (ii-3) and (iii-2), respectively, which were each added in the amount as shown in Table 1.

TABLE I

| | Compound added | Amount (part) |
|---|---|---|
| Example 1: | i-3 | 0.008 |
| Example 2: | i-19 | 0.004 |
| Example 3: | i-34 | 0.016 |
| Example 4: | ii-3 | 0.015 |
| Example 5: | iii-2 | 0.013 |

The dry process silver salt photosensitive materials of Examples 1 to 5, thus obtained, were each subjected to imagewise exposure and heat development in an environment of 25° C. and 60% RH, and optical densities at exposed areas and unexposed areas were measured. Here, a plurality of photosensitive materials having the same composition were prepared, and the heat development was carried out at varied heat development temperatures for each photosensitive material.

Results obtained are shown in Table 2.

The imagewise exposure was carried out using a polygon scanning type exposure machine having a semiconductor laser with an oscillation wavelength of 680 nm. The semiconductor laser had an energy of 30 μJ/cm$^2$ on the photosensitive material surface. The semiconductor laser also had a scanning speed of $1.67\times10^{-7}$ sec/dot.

The heat development was carried out, as shown in Table 2, at each temperature of 115° C., 120° C., 125° C., 130° C. and 135° C. The heat development time was set at 10 seconds in all instances.

The optical density was measured using an optical densitometer STD-TR, available from Narumi Co.

For comparison, Example 1 was also repeated to produce a dry process silver salt photosensitive material, except that none of the compounds (i), (ii) and (iii) were added. This dry process silver salt photosensitive material was evaluated in the same manner as in Examples 1 to 5 (Comparative Example 1).

TABLE 2

| | Development temperature (°C.) | | | | |
|---|---|---|---|---|---|
| | 115 | 120 | 125 | 130 | 135 |
| Example: | | | | | |
| 1 | $^{1.82}/_{0.16}$ | $^{2.70}/_{0.18}$ | $^{2.71}/_{0.19}$ | $^{2.67}/_{0.24}$ | $^{2.67}/_{0.26}$ |
| 2 | $^{1.53}/_{0.17}$ | $^{2.61}/_{0.18}$ | $^{2.65}/_{0.19}$ | $^{2.65}/_{0.20}$ | $^{2.69}/_{0.32}$ |
| 3 | $^{1.74}/_{0.18}$ | $^{2.66}/_{0.18}$ | $^{2.75}/_{0.20}$ | $^{2.72}/_{0.21}$ | $^{2.70}/_{0.31}$ |
| 4 | $^{1.67}/_{0.18}$ | $^{2.69}/_{0.19}$ | $^{2.74}/_{0.19}$ | $^{2.69}/_{0.20}$ | $^{2.65}/_{0.24}$ |
| 5 | $^{1.70}/_{0.18}$ | $^{2.60}/_{0.19}$ | $^{2.71}/_{0.20}$ | $^{2.73}/_{0.21}$ | $^{2.68}/_{0.34}$ |

TABLE 2-continued

| | Development temperature (°C.) | | | | |
|---|---|---|---|---|---|
| | 115 | 120 | 125 | 130 | 135 |
| Comparative Example: | | | | | |
| 1 | $^{1.62}/_{0.17}$ | $^{2.62}/_{0.19}$ | $^{2.69}/_{0.22}$ | $^{2.69}/_{0.46}$ | $^{2.65}/_{0.91}$ |

The numerical values in Table 2 show that in the case of e.g. "$^{1.82}/_{0.16}$" the left upper numeral 1.82 indicates optical density at the exposed area and the right lower numeral 0.16 indicates optical density (fog density) at the unexposed area.

As is seen from Table 2, there is no difference in optical density between the photosensitive material of Comparative Example 1 and the photosensitive materials of Examples 1 to 5 when the heat development is carried out at temperatures of 120° C. or below. However, at heat development temperatures of 125° C. or above, the fog density increases in the photosensitive material of Comparative Example 1, but on the other hand there are not so great changes in optical density in the photosensitive materials of Examples 1 to 5, showing that the latter have a broad temperature latitude.

Measurement (B)

Next, dry process silver salt photosensitive 10 materials respectively corresponding to Examples 1 to 5 and Comparative Example 1 were anew prepared, and these photosensitive materials were left to stand in a 50° C., 60% RH thermo-hygrostatic chamber for 48 hours. Thereafter, the imagewise exposure and heat development were carried out in the same manner as in measurement (A) and the evaluation was also made similarly.

Results obtained are shown in Table 3.

TABLE 3

| | Development temperature (°C.) | | | | |
|---|---|---|---|---|---|
| | 115 | 120 | 125 | 130 | 135 |
| Example: | | | | | |
| 1 | $^{1.64}/_{0.15}$ | $^{2.58}/_{0.18}$ | $^{2.69}/_{0.19}$ | $^{2.69}/_{0.25}$ | $^{2.65}/_{0.27}$ |
| 2 | $^{1.58}/_{0.17}$ | $^{2.60}/_{0.18}$ | $^{2.63}/_{0.19}$ | $^{2.66}/_{0.21}$ | $^{2.70}/_{0.33}$ |
| 3 | $^{1.61}/_{0.18}$ | $^{2.43}/_{0.19}$ | $^{2.68}/_{0.20}$ | $^{2.65}/_{0.20}$ | $^{2.71}/_{0.34}$ |
| 4 | $^{1.65}/_{0.18}$ | $^{2.62}/_{0.18}$ | $^{2.70}/_{0.20}$ | $^{2.70}/_{0.22}$ | $^{2.63}/_{0.29}$ |
| 5 | $^{1.66}/_{0.18}$ | $^{2.52}/_{0.19}$ | $^{2.58}/_{0.20}$ | $^{2.61}/_{0.20}$ | $^{2.55}/_{0.41}$ |
| Comparative Example: | | | | | |
| 1 | $^{0.82}/_{0.15}$ | $^{1.95}/_{0.18}$ | $^{2.51}/_{0.22}$ | $^{2.45}/_{0.53}$ | $^{2.43}/_{1.16}$ |

As is seen from Table 3, there are not so great changes in optical density in the photosensitive materials of Examples 1 to 5 even after the storage for a long period of time in the environment of high temperature and high humidity, showing that they have a broad latitude for heat development.

Example 6

Example 1 was repeated to obtain a dry process silver salt photosensitive material of the present invention, except that 2.4 parts of the reducing agent 2,2'-methylenebis(4-methyl-6-tert-butylphenol) used in Example 1 was replaced with 2.4 parts of 4,4'-methylenebis(2-methyl-6-tert-butylphenol).

The dry process silver salt photosensitive material thus obtained was left in the environment of high temperature and high humidity in the same manner as in measurement (B), and thereafter subjected to imagewise exposure, followed by heat development at 130° C. for 10 seconds. As a result, a good image was formed, having an absorbance peak wavelength of 410 nm at the imagewise exposed area.

Next, a peel-apart film (trade name: NEOTROCK, available from Nitto Electric Industrial Co., Ltd.) was prepared. A support of this peel-apart film on the one side was made to comprise a copper sheet, and, on its support (a release sheet) on the other side, the photosensitive material of the present Example, having an image formed therein as described above, was superposed. The resulting laminate comprised of the copper sheet, a resist sheet, the release sheet and the photosensitive material was uniformly exposed to light from the side of the photosensitive material for 5 seconds using an ultrahigh-pressure mercury lamp. Thereafter, the copper sheet and the release sheet were separated, so that only polymerized areas of the resist layer remained on the copper sheet. The polymerized areas of the resist layer corresponded to the areas imagewise-unexposed to the light from the semiconductor laser. The image formed of the polymerized areas, remaining on the copper sheet, was sharp and had a good resolution.

Example 7

Dispersion (d) was prepared in the same manner as in Example 1 except that in the dispersion (c) prepared therein 2.4 parts of 2,2'-methylenebis(4-methyl- 6-tert-butylphenol) was replaced with 1.0 part of 2,6-dichloro-4-aminophenol and 5.0 parts of dipentaerythritol hexaacrylate.

This dispersion (d) was coated on a PET film so as to be in a dried coating thickness of 5 μm to form a photosensitive layer, and also a 2 μm thick protective layer comprised of polyvinyl alcohol was provided on the photosensitive layer. Thus, a dry process silver salt photosensitive material of the present invention was obtained.

The photosensitive material thus obtained was left in the environment of high temperature and high humidity in the same manner as in measurement (B), and thereafter subjected to imagewise exposure, followed by heat development at 100° C. for 30 seconds. Thereafter, the resulting photosensitive material was washed with water to remove the protective layer, and then immersed in an ethanol bath. As a result, imagewise unexposed areas of the photosensitive layer were removed and imagewise exposed areas remained as a polymer image on the PET film.

Example 8

Using the same dry process silver salt photosensitive material as that in Example 7, imagewise exposure, heat development and etching were carried out in the same manner as in Example 7 except that the heat development was carried out at a temperature of 105° C. As a result, a polymer image was formed on the PET film as in Example 7.

Example 9

Using the same dry process silver salt photosensitive material as that in Example 7, imagewise exposure, heat development and etching were carried out in the same manner as in Example 7 except that the heat development was carried out at a temperature of 110° C. As a result, a polymer image was formed on the PET film as in Example 7.

Comparative Example 2

Example 7 was repeated to produce a dry process silver salt photosensitive material, except that the compound (i-3) was not added. This photosensitive material was prepared in plurality, and each photosensitive material was subjected to heat development at heat development temperatures changed to 100° C., 105° C. and 110° C. The imagewise exposure and etching were carried out in the same manner as in Example 7. As a result, a polymer image was formed when the heat development was carried out at temperature of 100° C., but no polymer image was formed when carried out at temperatures of 105° C. and 110° C.

Examples 10 to 12 & Comparative Example 3

In 100 parts of methyl ethyl ketone, 10 parts of polyvinyl butyral was dissolved, and also 4.0 parts of the compound (ii-3) was dispersed to produce dispersion (e). This dispersion (e) was coated on a PET film so as to be in a dried coating thickness of 3 μm, to form a second photosensitive layer. On this second photosensitive layer, the same dispersion (b) as used in Example 1 was coated so as to be in a dried coating thickness of 10 μm, to form a first photosensitive layer. Finally, a 2 μm thick protective layer comprised of polyvinyl alcohol was formed on the first photosensitive layer. Thus, a dry process silver salt photosensitive material of the present invention was produced (Example 10).

Example 10 was repeated to produce dry process silver salt photosensitive materials of Examples 11 and 12, except that 4.0 parts of compound (ii-3) was replaced with compounds (iii-4) and (iii-7), respectively, which were each added in the amount as shown in Table 4.

TABLE 4

| | Compound added | Amount (part) |
|---|---|---|
| Example 10: | ii-3 | 4.0 |
| Example 11: | iii-4 | 4.6 |
| Example 12: | iii-7 | 3.5 |

The dry process silver salt photosensitive materials of Examples 10 to 12, thus obtained, were each subjected to imagewise exposure and heat development in the same manner as in measurement (A) except that the semiconductor laser was made to have an energy of 20 μJ/cm$^2$ on the photosensitive material surface. Evaluation was made in the same manner as in Example 1.

Results obtained are shown in Table 5.

For comparison, the photosensitive material as used in Comparative Example 1 was also subjected to imagewise exposure and heat development in the same manner as in Examples 10 to 12, and evaluation was made similarly (Comparative Example 3).

TABLE 5

| | Development temperature (°C.) | | | | |
|---|---|---|---|---|---|
| | 115 | 120 | 125 | 130 | 135 |
| Example: | | | | | |
| 10 | 1.45/ /0.13 | 2.62/ /0.14 | 2.76/ /0.15 | 2.69/ /0.18 | 2.52/ /0.21 |
| 11 | 1.31/ /0.12 | 2.54/ /0.13 | 2.56/ /0.15 | 2.55/ /0.19 | 2.49/ /0.29 |
| 12 | 1.31/ /0.12 | 2.45/ /0.13 | 2.49/ /0.16 | 2.48/ /0.20 | 2.44/ /0.27 |

TABLE 5-continued

| | Development temperature (°C.) | | | | |
|---|---|---|---|---|---|
| | 115 | 120 | 125 | 130 | 135 |
| Comparative Example: | | | | | |
| 3 | 1.34/ /0.17 | 2.25/ /0.19 | 2.51/ /0.22 | 2.57/ /0.46 | 2.45/ /0.91 |

As is seen from Table 5, the photosensitive materials of Examples 10 to 12 cause not so great changes in optical density even when the heat development temperature is changed, and have a broad latitude for heat development.

What is claimed is:

1. A dry process silver salt photosensitive material comprising a support and provided thereon a photosensitive layer containing at least an organic silver salt, a reducing agent and a photosensitive silver halide or a photosensitive silver halide forming component; said photosensitive layer being incorporated with a compound selected from the following compound (i) and compound (ii): Compound (i):

$$[T^+X^-]Z_2$$

wherein $T^+$ is an organic coloring matter cationic residual group selected from the group consisting of a cyanine dye residual group, a styryl dye residual group, an aminovinyl dye residual group, an anilane dye residual group, a xanthane dye residual group and a phenoxazium dye residual group, $X^-$ is a halide counter anion, and Z is a halogen atom selected from the group consisting of Br, I and Cl Compound (ii) is represented by the following Formula I:

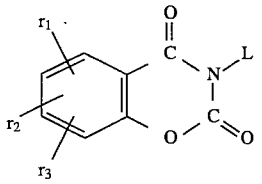

Formula (I)

wherein $r_1$, $r_2$ and $r_3$ are the same or different and each is a hydrogen atom, an alkyl group, an alkoxy group, a halogen atom, a hydroxyl group, an aryl group, an aralkyl group, an alkoxyalkoxyl group or an amino group, where any two of $r_1$, $r_2$ and $r_3$ combine to form a condensed ring; and L is a halogen atom.

2. The dry process silver salt photosensitive material according to claim 1, wherein said halogen atom L is Br, I or Cl.

3. The dry process silver salt photosensitive material according to claim 1, wherein said photosensitive layer is a laminate comprising a first photosensitive layer containing a) said organic silver salt, b) said reducing agent and c) said photosensitive silver halide or photosensitive silver halide forming component, and a second photosensitive layer containing e) a compound selected from said compounds (i) and (ii).

4. The dry process silver salt photosensitive material according to claim 1, wherein said photosensitive layer is a single layer.

5. The dry process silver salt photosensitive material according to claim 1, wherein said photosensitive layer contains a polymerizable polymer precursor and a polymerization initiator.

6. The dry process silver salt photosensitive material according to claim 1, which further comprises a polymerizing layer containing a polymerizable polymer precursor and a polymerization initiator.

7. An image forming method comprising subjecting the dry process silver salt photosensitive material according to claim 1, to imagewise exposure and heating to form an image.

8. An image forming method comprising subjecting the dry process silver salt photosensitive material according to claim 5 or 6, to imagewise exposure and heating to form an image.

9. The image forming method according to claim 8, wherein polymerization exposure is further carried out after said heating.

* * * * *

UNITED STATES PATENT AND TRADEMARK OFFICE

CERTIFICATE OF CORRECTION

PATENT NO. : 5,547,831

DATED : August 20, 1996

INVENTOR(S) : TETSURO FUKUI ET AL.

It is certified that error appears in the above-identified patent and that said Letters Patent is hereby corrected as shown below:

AT [57] ABSTRACT

Line 7, "(i), (ii) and (iii)" should read --(i) and (ii)--.

COLUMN 6

Line 18, "trifluoacetate" should read --trifluroacetate--.

COLUMN 15

Example (iii-6),

" 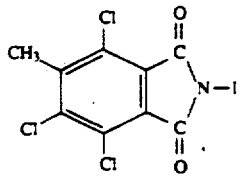 " should read -- 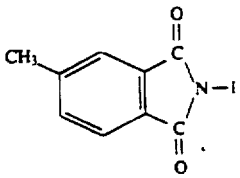 --.

COLUMN 18

Line 22, "tetrazola" should read --tetrazole--.

UNITED STATES PATENT AND TRADEMARK OFFICE

CERTIFICATE OF CORRECTION

PATENT NO. : 5,547,831

DATED : August 20, 1996

INVENTOR(S) : TETSURO FUKUI ET AL.

It is certified that error appears in the above-identified patent and that said Letters Patent is hereby corrected as shown below:

COLUMN 26

Line 46, "combine" should read --may combine--.

Signed and Sealed this

Seventeenth Day of December, 1996

Bruce Lehman

*Attest:*

BRUCE LEHMAN

*Attesting Officer*

*Commissioner of Patents and Trademarks*